US007231687B2

(12) United States Patent
Rew et al.

(10) Patent No.: US 7,231,687 B2
(45) Date of Patent: Jun. 19, 2007

(54) VACUUM CLEANER WITH FLOW CHANNEL SWITCH FOR BLOWING AND SUCKING AIR

(75) Inventors: Ho-Seon Rew, Seoul (KR); Yong-Woo Lee, Seoul (KR); Hyeon-Sik Nam, Seoul (KR); Choon-Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 569 days.

(21) Appl. No.: 10/743,494

(22) Filed: Dec. 23, 2003

(65) Prior Publication Data

US 2004/0250373 A1 Dec. 16, 2004

(30) Foreign Application Priority Data

Jun. 12, 2003 (KR) ..... 10-2003-0037916

(51) Int. Cl.
*A47L 5/14* (2006.01)

(52) U.S. Cl. ..... 15/330; 15/331; 15/334

(58) Field of Classification Search ..... 15/330, 15/331, 334, 335
See application file for complete search history.

(56) References Cited

U.S. PATENT DOCUMENTS 2,227,302 A * 12/1940 Edstrom ..... 15/330
4,663,799 A 5/1987 Kiyooka ..... 15/330
5,243,733 A 9/1993 Steiner et al. ..... 15/330
5,355,549 A * 10/1994 Steinberg et al. ..... 15/334
6,079,077 A * 6/2000 Kajihara et al. ..... 15/331
7,069,619 B2 * 7/2006 Bowden et al. ..... 15/335
2004/0237246 A1 * 12/2004 Nam et al. ..... 15/334

FOREIGN PATENT DOCUMENTS

CN 2435590 Y 6/2001
CN 2488461 Y 5/2002
JP 2001-198054 A 7/2001
WO WO-97/30620 A1 8/1997

* cited by examiner

*Primary Examiner*—Theresa T. Snider
(74) *Attorney, Agent, or Firm*—Birch, Stewart, Kolasch & Birch, LLP

(57) ABSTRACT

In a vacuum cleaner, by including a casing having a certain internal space; a suction force generating unit installed in the casing to generate a suction force and discharge sucked air; a head unit combined with the casing to suck impurities on the bottom with air by a suction force of the suction force generating unit or discharge air sucked from the outside; a filter unit for filtering off impurities in air sucked through the head unit or ambient air received from the outside; a flow channel switch connected with the head unit, the filter unit and the suction force generating unit so as to selectively switch a flow channel in order to guide air including impurities sucked through the head unit by the suction force of the suction force generating unit or make ambient air introduced in the flow channel switch flow to the head unit; and plural pipes for providing passages of air flowing in the head unit, the filter unit, the suction force generating unit and the flow channel switch, it is possible to perform not only a function for suctioning those on the surface to be cleaned but also a function for blowing dirt or debris lay on curtains or window frames.

14 Claims, 4 Drawing Sheets

VACUUM CLEANER WITH FLOW CHANNEL SWITCH FOR BLOWING AND SUCKING AIR

This Nonprovisional application claims priority under 35 U.S.C. § 119(a) on Patent Application No(s). 10-2003-0037916 filed in Korea on Jun. 12, 2003, the entire contents of which are hereby incorporated by reference.

BACKGROUND OF THE INVENTION

1. Field of the Invention

The present invention relates to a vacuum cleaner, and in particular to a vacuum cleaner used for blowing dirt or debris on curtains or window frames as well as for suctioning those on the surface to be cleaned.

2. Description of the Related Art

In general, a vacuum cleaner is an electric home appliance for cleaning an indoor space of a house or a building or a car. It is possible to remove impurities such as dust by using a vacuum suction force of the vacuum cleaner.

FIG. 1 is a perspective view illustrating the conventional vacuum cleaner, and FIG. 2 is a plane view illustrating a main body of the conventional vacuum cleaner.

As depicted in FIGS. 1 and 2, the vacuum cleaner includes a main body 1 having a suction fan for generating a suction force; a flexible hose 2 connected to the front of the main body 1 to guide impurities sucked from a surface to be cleaned; a handle 3 combined with an end of the flexible hose 2 so as to have a selection mode for selecting a cleaning mode by a user; an extended pipe 4 extended-combined with the other end of the handle 3; and a head unit 5 combined with the end of the extended pipe 4 in order to suck impurities from a surface to be cleaned.

The main body 1 of the vacuum cleaner includes a casing 1*a* for forming an external shape and an internal space; a suction force generating unit 1*b* having a suction fan installed at a side of the casing 1*a* and a motor; a filter unit 1*c* installed at the other side of the casing 1*a* so as to have a filter; a suction pipe 1*d* for connecting the flexible hose 2 to a side of the filter unit 1*c* and guiding impurities sucked into the flexible hose 2 into the filter unit 1*c*; a guide pipe 1*e* for connecting the filter unit 1*c* with the suction force generating unit 1*b* and guiding air passed the filter unit 1*c* into the suction force generating unit 1*b*; and a discharge pipe 1*f* connected to the suction force generating unit 1*b* to discharge air passed the filter unit 1*c* to the outside.

The operation of the conventional vacuum cleaner will be described.

First, when a user applies power to the vacuum cleaner and selects a cleaning mode with the selection mode on the handle 3, a suction force is generated by the suction force generating unit 1*b*, and accordingly the user performs cleaning by holding the handle 3 and moving the head unit 5 back-force and left-right. Herein, impurities on the bottom surface are sucked through a nozzle (not shown) of the head unit 5, pass the extended pipe 4 and flexible hose 2 and are filtered by the filter unit 1*c* connected to the suction pipe 1*d*. The filtered air passes the guide pipe 1*e* and the suction force generating unit 1*b* and is discharged to the outside through a discharge hole D formed at a side of the discharge pipe 1*f* and the casing 1*a*.

Because the conventional vacuum cleaner has a function only for sucking impurities on the bottom surface by using a suction force, the conventional vacuum cleaner cannot shake the dust off a window frame and brushing up the dust on a fabric such as a curtain or it is difficult for the conventional vacuum cleaner to remove the dust because a fabric is stuck on the head unit of the vacuum cleaner.

SUMMARY OF THE INVENTION

In order to solve the above-mentioned problems, it is an object of the present invention to provide a vacuum cleaner capable of performing not only a suction cleaning but also a blow cleaning.

In order to achieve the above-mentioned object, a vacuum cleaner in accordance with the present invention includes a casing having a certain internal space; a suction force generating unit installed in the casing so as to generate a suction force; a head unit connected with the casing so as to have cleaning implement and provide a flow channel for removing impurities outside; a filter unit installed in the casing for filtering off impurities in air sucked from the outside; a flow channel switch means installed in the casing for selectively switching a flow channel of air flowing through among the head unit, the filter unit and the suction force generating unit; and plural pipes for providing passages of air flowing in the head unit, the filter unit, the suction force generating unit and the flow channel switch means.

A vacuum cleaner in accordance with the present invention includes a casing having a certain internal space; a suction force generating unit installed in the casing to generate a suction force and discharge sucked air; a head unit combined with the casing to suck impurities on the bottom with air by a suction force of the suction force generating unit or discharge ambient air sucked from the outside; a filter unit for filtering off impurities in air sucked through the head unit or ambient air received from the outside; a flow channel switch means connected with the head unit, the filter unit and the suction force generating unit so as to selectively switch a flow channel for guiding air including impurities sucked in through the head unit by the suction force of the suction force generating unit or making ambient air introduced in the flow channel switch means flow to the head unit; and plural pipes for providing passages of air flowing through among the head unit, the filter unit, the suction force generating unit and the flow channel switch means.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
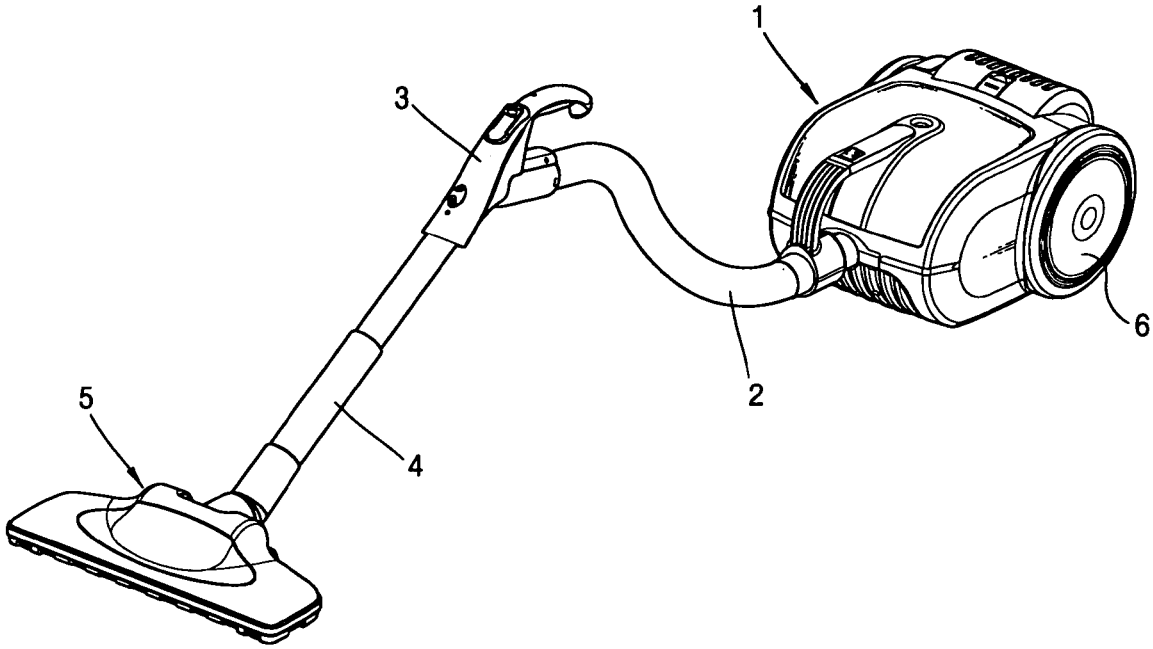
FIG. 1 CONVENTIONAL ART
FIG. 1 is a perspective view illustrating the conventional vacuum cleaner.
Figure 2:
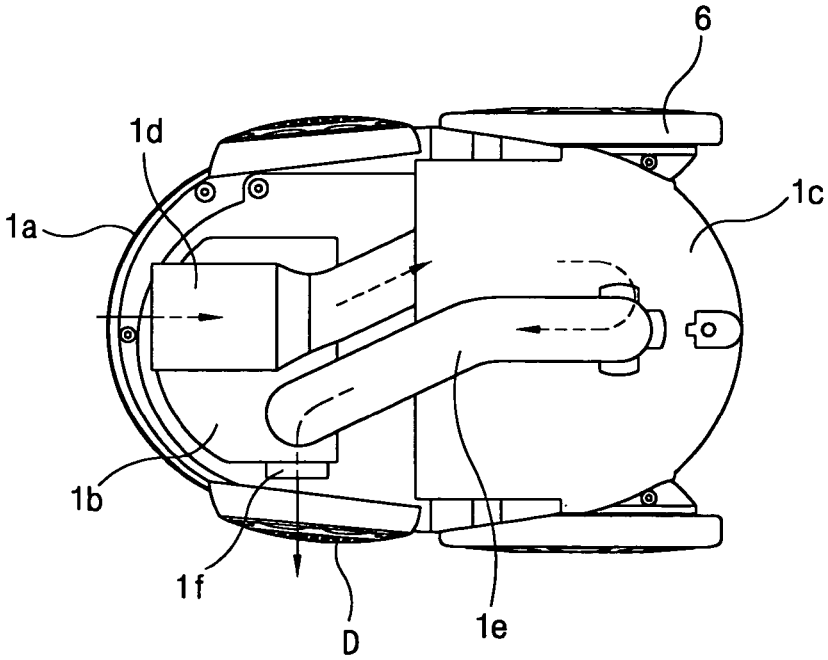
FIG. 2 CONVENTIONAL ART
FIG. 2 is a sectional-plane view illustrating part of a main body of the conventional vacuum cleaner.
Figure 3:
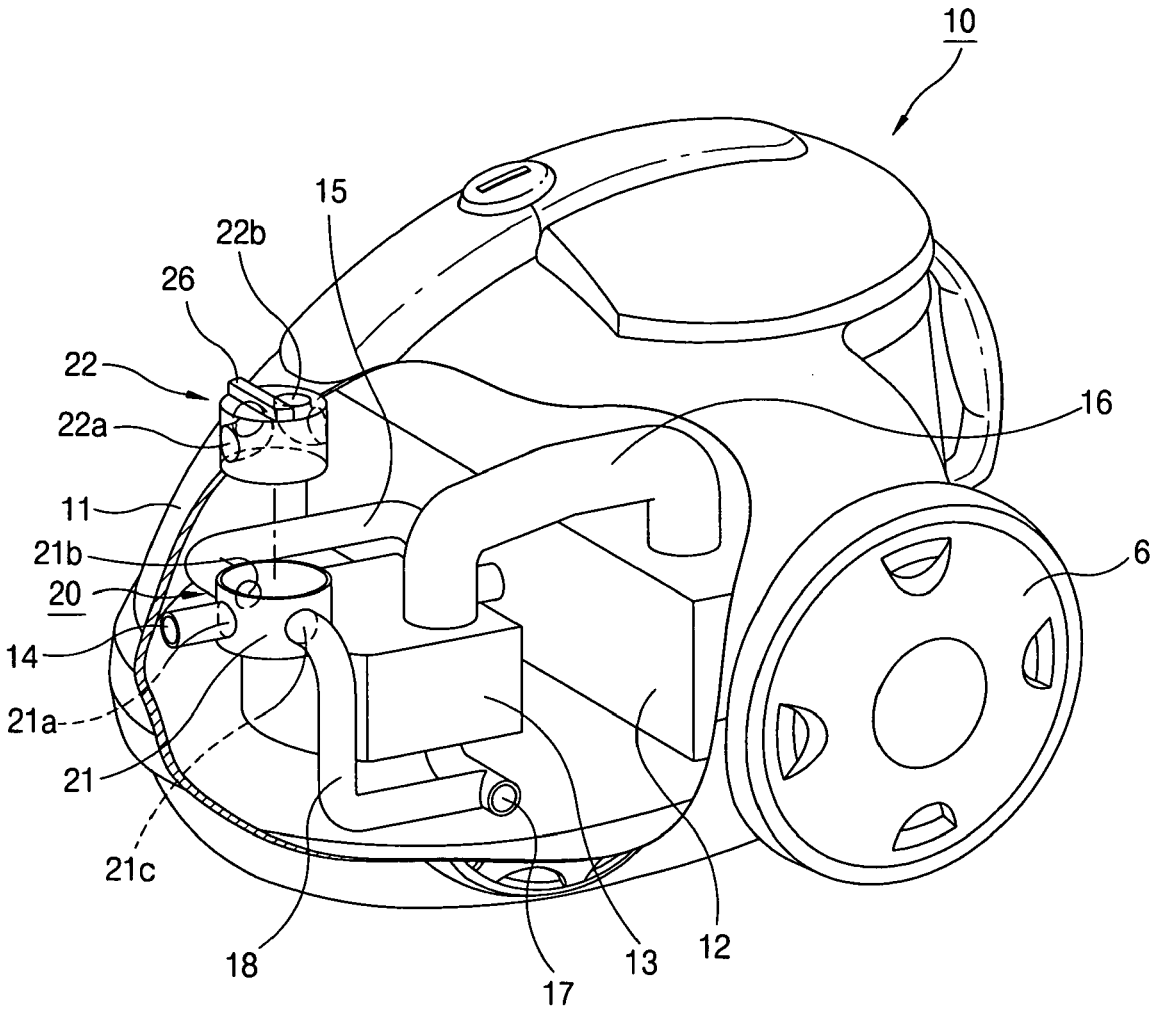
FIG. 3 is a perspective view illustrating part of a main body of a vacuum cleaner in accordance with the present invention.
Figure 4:
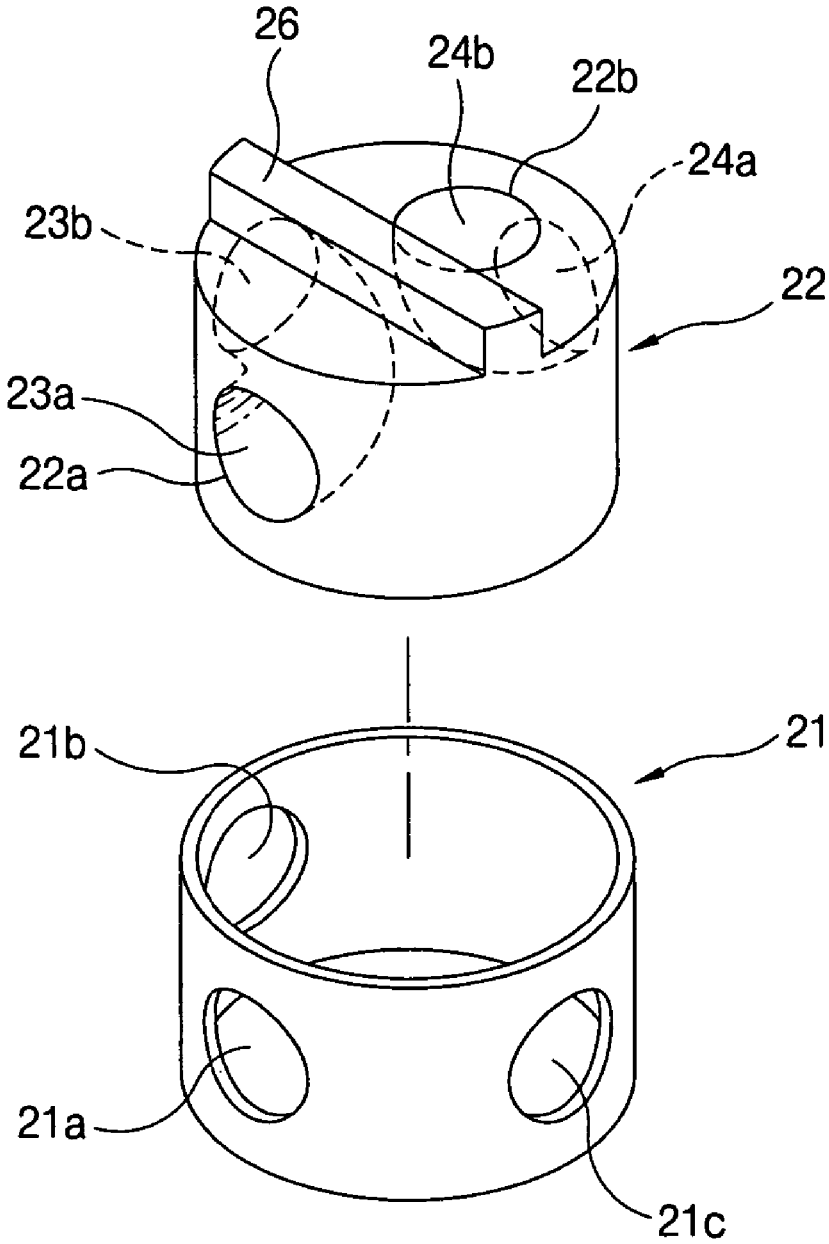
FIG. 4 is an exploded-perspective view illustrating a flow channel switch means of the vacuum cleaner in accordance with the present invention.

Hereinafter, the preferred embodiment of a vacuum cleaner in accordance with the present invention will be described in detail.

Same part with those of the conventional art will have the same reference numerals.

As depicted in FIGS. 3~5B, a main body 10 of a vacuum cleaner in accordance with the present invention includes a casing 11 for forming a certain internal space; a suction force generating unit 13 installed at a side of the casing 11 to generate a suction force; a filter unit 12 installed at a side of the suction force generating unit 13 so as to be connected with the suction force generating unit 13, and having a filter (not shown) for separating impurities from the sucked air; and a flow channel switch means 20 for connecting the head unit 5 with the filter unit 12 or the suction force generating unit 13 selectively.

In order to make airs flow the construction parts of the main body 10, the pipes are connected as described hereinbelow.

A main inflow pipe 15 is connected between the filter unit 12 and the flow channel switch means 20 in order to make air and impurities flow into the filter unit 12, and a guide pipe 16 is connected between the filter unit 12 and the suction force generating unit 13 in order to guide the air filtered through the filter unit 12 to the suction force generating unit 13. A main discharge pipe 17 is connected to a side of the suction force generating unit 13 in order to discharge the air from the suction force generating unit 13 to the outside, and a sub-discharge pipe 18 is connected between the main discharge pipe 17 and the flow channel switch means 20 in order to make part of air discharged to the outside through the main discharge pipe 17 diverge from the main discharge pipe 17 and flow to the flow channel switch means 20.

The flow channel switch means 20 includes a valve housing 21 fixed-installed to the casing 11; and a flow channel switch valve 22 rotatively combined with the valve housing 21 so as to convert a flow direction of a fluid.

The valve housing 21 is a cylinder having a certain height, and it includes a first through hole 21*a* connected to the head unit 5 through a head unit connecting pipe 14 and a second through hole 21*b* formed so as to be on the same horizontal level as the first through hole 21*a* along the circumference and be at an interval of 90 degrees, herein, the second through hole 21*b* is connected to the main inflow pipe 15. In addition, the valve housing 21 further includes a third through hole 21*c* formed so as to be on the same horizontal level as the second through hole 21*b* along the circumference and be at an interval of 180 degrees, herein, the third through hole 21*c* is connected to the sub-discharge pipe 18.

The flow channel switch means 22 has a cylindrical shape so as to be inserted into the valve housing 21, and it includes a first flow channel 22*a* for connecting the first through hole 21*a* with the second through hole 21*b* or the third through hole 21*c* of the valve housing 21 selectively; and a second flow channel 22*b* penetrating the first flow channel 22*a* in the vertical direction. When the first flow channel 22*a* connects the first through hole 21*a* with the second through hole 21*b*, the second flow channel 22*b* is cut off by the valve housing 21. On the contrary, when the first flow channel 22*a* connects the first through hole 21*a* with the third through hole 21*c*, the second flow channel 22*b* directly connects ambient air to the second through hole 21*b*.

Herein, a first through hole 23*a* and a second through hole 23*b* respectively formed at both ends of the first flow channel 22*a* are formed so as to be horizontal along the circumference and at an interval of 90 degrees. In the second flow channel 22*b*, a third through hole 24*a* is formed so as to be separated from the first through hole 23*a* at an interval of 180 degrees along the circumference, and a fourth through hole 24*b* is formed on the top surface of the flow channel switch valve 22 so as to be exposed to the outside.

In addition, a valve knob 26 is formed on the top surface of the flow channel switch valve 22 so as to be exposed to the outside of the casing 11 of the main body 10 together with the fourth through hole 24*b* in order to make the user adjust the flow channel switch valve 22 easily. The valve knob 26 can project from the top surface of the flow channel switch valve 22 so as to have a certain length and width or can be formed as various shapes.

In another embodiment of the present invention, by installing an additional electronic device, it is possible to adjust the flow channel switch valve 22 automatically.

The operation of the vacuum cleaner in accordance with the present invention will be described.

Figure 5A:
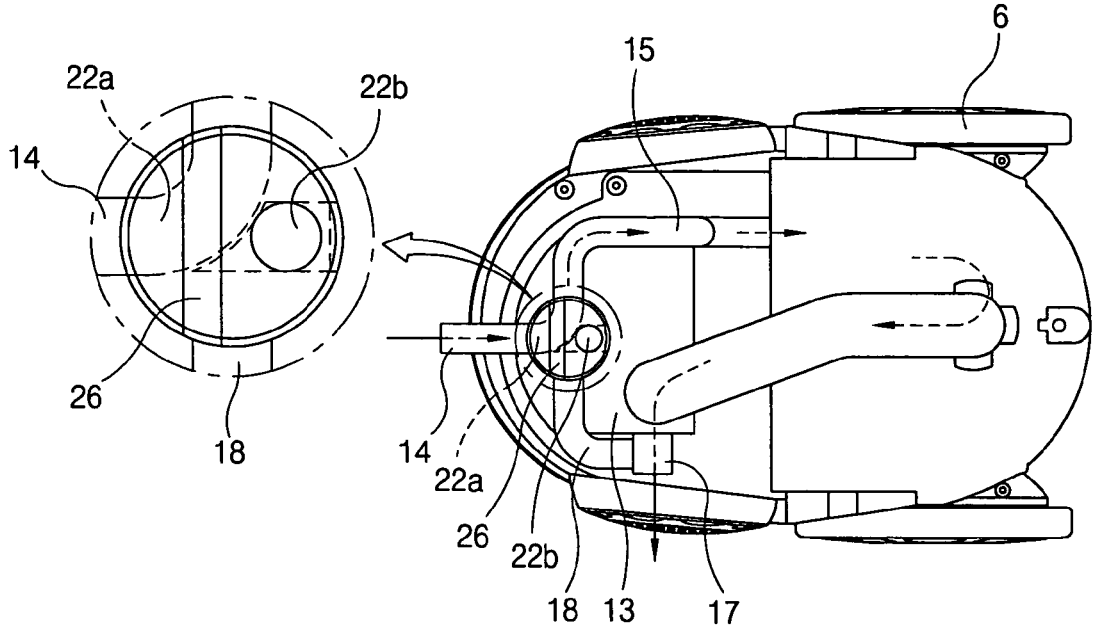
FIG. 5A is a perspective view illustrating a suction mode of the vacuum cleaner in accordance with the present invention.

First, in order to perform a general suction cleaning mode, as depicted in FIG. 5*a*, when the user holds the handle 3 (shown in FIG. 1), applies power to the main body 10 and switches the flow channel switch valve 22 to make the head unit 5 (shown in FIG. 1) connect with the filter 12 through the first flow channel 22*a* of the flow channel switch valve 22.

Herein, by the suction force of the suction force generating unit 13, sucked air and impurities on the surface (to be cleaned) are sucked into the filter unit 12 by passing the head unit 5, the extended pipe 4 (shown in FIG. 1), the flexible hose 2 (shown in FIG. 1), the head unit connecting pipe 14, the first flow channel 22*a* and the main inflow pipe 15. In the filter unit 12, the impurities are separated from the air by the filter 12; the impurities are caught by the filter unit 12; however, the air is discharged to the outside of the casing 10 through the guide pipe 16 and the main discharge pipe 17. Herein, the sub-discharge pipe 18 diverged from the main discharge pipe 17 is closed by the flow channel switch valve 22, and accordingly air through the main discharge pipe 17 is discharged to the outside of the casing 11 of the main body 10.

Figure 5B:
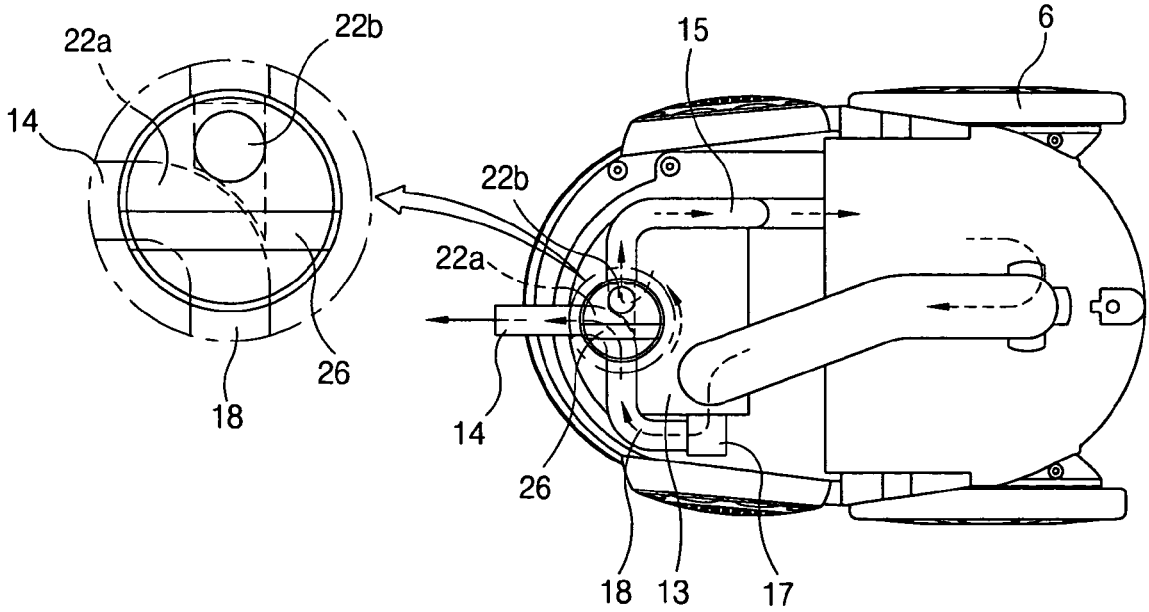
FIG. 5B is a perspective view illustrating a blow mode of the vacuum cleaner in accordance with the present invention.

In the meantime, in order to perform the blow cleaning mode by using the cleaner in accordance with the present invention, as depicted in FIG. 5*b*, the user switches the flow channel switch valve 22 to the blow cleaning mode in order to connect the head unit 5 with the main discharge pipe 17 through the first flow channel 22*a* and the sub-discharge pipe 18.

Herein, by connecting the third through hole 24*a* at the outlet side of the second flow channel 22*b* with the filter unit 12 through the main inflow pipe 15, ambient air flows into the filter unit 12 through the second flow channel 22*b* and the main inflow pipe 15 by the suction force generated by the suction force generating unit 13, the air in the filter unit 12 flows to the suction force generating unit 13 through the guide pipe 16, part of the air is discharged to the outside of the casing 11 through the main discharge pipe 17 or the rest is discharged to the first flow channel 22*a* through the sub-discharge pipe 18. The air in the first flow channel 22*a* blows dust on a window frame or a recess while being discharged through the head unit 5.

In addition, by using the same hose as it is, it is possible to simplify a construction of the vacuum cleaner and facilitate a cleaning operation. And, it is possible to reduce an additional cost, minimize increase of a production cost and diversify vacuum cleaner's functions.

What is claimed is:

1. A vacuum cleaner, comprising:

a casing having a certain internal space;

a suction force generating unit installed in the casing so as to generate a suction force;

a head unit connected with the casing to provide a flow channel;

a filter unit installed in the casing for filtering off impurities in air sucked from outside;

flow channel switch means installed in the casing for selecting a flow channel of the air flowing through one of a plurality of combinations of the head unit, the filter unit and the suction force generating unit; and plural pipes connecting the head unit, the filter unit, the suction force generating unit and the flow channel switch means, wherein the plural pipes include:

a head unit connecting pipe formed on a side of the flow channel switch means connected with the head unit;

a main inflow pipe installed between the flow channel switch means and the filter unit;

a guide pipe connecting the filter unit with the suction force generating unit;

a main discharge pipe connected to a side of the suction force generating unit for making air flowing from the filter unit into the suction force generating unit discharge to the outside; and a sub-discharge pipe connecting the flow channel switch means with the main discharge pipe, wherein the flow channel switch means includes:

a valve housing fixedly installed to the casing so as to have plural through holes connected to the head unit connecting pipe, the main inflow pipe and the sub-discharge pipe; and a flow channel switch valve rotatively inserted into the valve housing so as to have plural channels connected to the plural through holes, wherein the plural through holes of the valve housing includes a first through hole connected to the head unit connecting pipe, a second through hole connected to the main inflow pipe and a third through hole connected to the sub-discharge pipe, and the plural flow channels of the flow channel switch valve includes a first flow channel connecting the first through hole of the valve housing with the second or the third through hole of the valve housing and a second flow channel connecting the second through hole of the valve housing with ambient air when the first flow channel connects the first through hole with the third through hole of the valve housing.

2. The vacuum cleaner of claim 1, wherein the plural through holes of the valve housing are formed at an interval of 90 degrees from each other.

3. The vacuum cleaner of claim 1, wherein the first through hole of the valve housing is formed at an interval of 90 degrees from the second through hole thereof and the third through hole of the valve housing is formed at an interval of 180 degrees from the second through hole thereof.

4. The vacuum cleaner of claim 1, wherein the second flow channel of the flow channel switch valve is in a direction different from the first flow channel.

5. The vacuum cleaner of claim 4, wherein at least one of through holes formed on both ends of the second flow channel is directly communicated to ambient air.

6. The vacuum cleaner of claim 1, wherein a part of the flow channel switch valve is exposed to the outside of the casing.

7. The vacuum cleaner of claim 6, wherein a knob is formed on the top surface of part of the flow channel switch valve exposed to the outside for facilitating handling of the flow channel switch valve.

8. The vacuum cleaner of claim 7, wherein the knob projects from the top surface of the flow channel switch valve.

9. A vacuum cleaner, comprising:

a casing having a certain internal space;

a suction force generating unit installed in the casing so as to generate a suction force;

a head unit connected with the casing so as to provide a flow channel;

a filter unit installed in the casing for filtering off impurities in air sucked from outside;

flow channel switch means installed in the casing for selecting a flow channel of the air flowing through one of a plurality of combinations of the head unit, the filter unit and the suction force generating unit; and plural pipes connecting the head unit, the filter unit, the suction force generating unit and the flow channel switch means, wherein the plural pipes include:

a head unit connecting pipe formed on a side of the flow channel switch means connected with the head unit;

a main inflow pipe installed between the flow channel switch means and the filter unit;

a guide pipe connecting the filter unit with the suction force generating unit;

a main discharge pipe connected to a side of the suction force generating unit for making air flowing from the filter unit into the suction force generating unit discharge to the outside; and a sub-discharge pipe connecting the flow channel switch means with the main discharge pipe, wherein the sub-discharge pipe is diverged from a middle portion of the main discharge pipe and is integrally formed with the main discharge pipe.

10. A vacuum cleaner, comprising:

a casing having a certain internal space;

a suction force generating unit installed in the casing to generate a suction force and discharge sucked air;

a head unit combined with the casing to suck impurities below the head unit with air by a suction force of the suction force generating unit or discharge ambient air sucked from the outside;

a filter unit for filtering off impurities in air sucked through the head unit or ambient air received from the outside;

flow channel switch means connected with the head unit, the filter unit and the suction force generating unit for selecting a flow channel of the air flowing from the head unit by the suction force of the suction force generating unit to the filter unit or from the filter unit to the head unit; and plural pipes connecting the head unit, the filter unit, the suction force generating unit and the flow channel switch means, wherein the plural pipes includes:

a head unit connecting pipe formed on a side of the flow channel switch means connected with the head unit;

a main inflow pipe installed between the flow channel switch means and the filter unit;

a guide pipe connecting the filter unit with the suction force generating unit;

a main discharge pipe connected to a side of the suction force generating unit for making air sucked from the filter unit into the suction force generating unit discharge to the outside; and a sub-discharge pipe connecting the flow channel switch means with the main discharge pipe, wherein the flow channel switch means includes:

a valve housing fixedly installed to the casing so as to have plural through holes connected to the head unit connecting pipe, the main inflow pipe and the sub-discharge pipe; and a flow channel switch valve rotatively inserted into the valve housing so as to have plural channels connected to the plural through holes, wherein the plural through holes of the valve housing includes a first through hole connected to the head unit connecting pipe, a second through hole connected to the main inflow pipe and a third through hole connected to the sub-discharge pipe, and the plural flow channels of the flow channel switch valve includes a first flow channel connecting the first through hole of the valve housing with the second or the third through hole of the valve housing and a second flow channel connecting the second through hole of the valve housing with the ambient air when the first flow channel connects the first through hole with the third through hole of the valve housing.

11. The vacuum cleaner of claim 10, wherein the plural through holes of the valve housing are formed at an interval of 90 degrees from each other.

12. The vacuum cleaner of claim 10, wherein the second flow channel of the flow channel switch valve is in a direction different from the first flow channel.

13. The vacuum cleaner of claim 10, wherein at least one of the through holes formed on both ends of the second flow channel is in contact with ambient air.

14. A vacuum cleaner, comprising:

a casing having a certain internal space;

a suction force generating unit installed in the casing to generate a suction force and discharge sucked air;

a head unit combined with the casing to suck impurities below the head unit with air by a suction force of the suction force generating unit or discharge ambient air sucked from the outside;

a filter unit for filtering off impurities in air sucked through the head unit or ambient air received from the outside;

flow channel switch means connected with the head unit, the filter unit and the suction force generating unit for selecting a flow channel of the air flowing from the head unit by the suction force of the suction force generating unit to the filter unit or from the filter unit to the head unit; and plural pipes connecting the head unit, the filter unit, the suction force generating unit and the flow channel switch means, wherein the plural pipes includes:

a head unit connecting pipe formed on a side of the flow channel switch means connected with the head unit;

a main inflow pipe installed between the flow channel switch means and the filter unit;

a guide pipe connecting the filter unit with the suction force generating unit;

a main discharge pipe connected to a side of the suction force generating unit for making air sucked from the filter unit into the suction force generating unit discharge to the outside; and a sub-discharge pipe connecting the flow channel switch means with the main discharge pipe, wherein the sub-discharge pipe is diverged from a middle portion of the main discharge pipe and is integrally formed with the main discharge pipe.

* * * * *